US007275673B2

(12) United States Patent
Zahner et al.

(10) Patent No.: US 7,275,673 B2
(45) **Date of Patent: *Oct. 2, 2007**

(54) COMBUSTION-ENGINED SETTING TOOL

(75) Inventors: Mario Zahner, Chur (CH); Ulrich Rosenbaum, Wangs (CH); Dierk Tille, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 38 days.

This patent is subject to a terminal disclaimer.

(21) Appl. No.: 11/351,034

(22) Filed: Feb. 8, 2006

(65) Prior Publication Data

US 2006/0175374 A1 Aug. 10, 2006

(30) Foreign Application Priority Data

Feb. 10, 2005 (DE) ..... 10 2005 006 167

(51) Int. Cl.
*B25C 1/08* (2006.01)
*B27F 7/09* (2006.01)

(52) U.S. Cl. ..... 227/10; 227/8; 227/130; 227/134

(58) Field of Classification Search ..... 227/9–11, 227/130, 134
See application file for complete search history.

(56) References Cited

U.S. PATENT DOCUMENTS 3,042,008 A * 7/1962 Liesse ..... 123/46 SC
3,438,406 A * 4/1969 Rozmus ..... 140/93.2
3,506,178 A * 4/1970 Brunelle ..... 227/10
3,924,789 A * 12/1975 Avery et al. ..... 227/131
4,093,110 A * 6/1978 Johnson ..... 227/9
4,200,213 A * 4/1980 Liesse ..... 227/10
4,483,473 A * 11/1984 Wagdy ..... 227/8
4,544,090 A * 10/1985 Warman et al. ..... 227/131
4,662,557 A * 5/1987 Lee ..... 227/147
4,717,060 A * 1/1988 Cotta ..... 227/10
5,114,064 A * 5/1992 Jochum et al. ..... 227/9
5,205,328 A * 4/1993 Johnson et al. ..... 140/93.2
6,145,724 A * 11/2000 Shkolnikov et al. ..... 227/8
6,260,519 B1 * 7/2001 Phillips ..... 123/46 R
6,786,378 B2 * 9/2004 Wagdy et al. ..... 227/9
7,086,574 B2 * 8/2006 Dittrich et al. ..... 227/10
7,128,252 B2 * 10/2006 Boenig et al. ..... 227/10

* cited by examiner

*Primary Examiner*—Rinaldi I. Rada
*Assistant Examiner*—Lindsay Low
(74) *Attorney, Agent, or Firm*—Abelman, Frayne & Schwab

(57) ABSTRACT

A combustion-engined setting tool for driving fastening elements in a constructional component, includes a guide cylinder (12), a setting piston (11) displaceable in the guide cylinder (12), a combustion chamber sleeve (15) displaceably arranged at the first axial end (27) of the guide cylinder (12), a press-on element (30) supported at the second axial end (28) of the guide cylinder (12), and a transmission device for connecting the press-on element (30) with the combustion chamber sleeve (15) and formed as a cable drive (20) having a transmission member (21, 121) and at least one deflection roller (24, 124) for the transmission member (21, 121) and supported on the press-on element (30).

10 Claims, 4 Drawing Sheets

COMBUSTION-ENGINED SETTING TOOL

BACKGROUND OF THE INVENTION

1. Field of the Invention

The present invention relates to a combustion-engined setting tool for driving fastening elements in a constructional component and including a guide cylinder having opposite first and second axial ends, a setting piston displaceable in the guide cylinder, a combustion chamber sleeve displaceably arranged at the first axial end of the guide cylinder, a press-on element supported at the second axial end of the guide cylinder for displacement relative thereto, and a transmission device for connecting the press-on element with the combustion chamber sleeve for converting a press-on displacement of the press-on element into displacement of the combustion chamber sleeve.

2. Description of the Prior Art

Setting tools of the type described above are operated with gaseous or liquid fuels that should be evaporated before combustion. The setting energy for driving in a fastening element is produced by combustion of a fuel gas-oxidant mixture in a combustion chamber and is transmitted to the fastening element by a setting piston. The oxidant is, e.g., oxygen of the environmental air.

In order to be able to carry out a setting process, the setting tool should be pressed against a constructional component to prevent actuation of the setting tool without a contact with the constructional component. The press-on stroke should be as small as possible for ergonomical reasons.

German Publication DE 40 32 203 A1 discloses a combustion-engined setting tool including a combustion chamber for combusting an air-fuel mixture and a setting piston displaceable in a guide cylinder and driven by a working pressure produced by the combustion of the air-fuel mixture. The combustion chamber is located in a first section of the setting tool housing, with the second housing section being displaceable relative to the first housing section. Further, the guide cylinder is likewise displaceable relative to the combustion chamber, being displaceable by an intermediate rack-and-pinion gear upon displacement of the second housing section relative to the first housing section. The relative movement of the second housing section relative to the first housing section upon pressing of the setting tool against the constructional component, provides for displacement of the guide cylinder away from the combustion chamber and, thus, for expansion of the combustion chamber volume.

The combustion chamber is divided in sub-chambers. These sub-chambers are separated by at least one displaceable intermediate or separation wall displaceable together with the guide cylinder. For evacuating the flue gases from the combustion space, the guide cylinder is displaced, together with an arranged thereon, combustion chamber wall, into the combustion chamber, reducing the volume of both sub-chambers to a minimum. The intermediate wall is displaced together with the guide cylinder. The flue gases are removed from the setting tool. When the sub-chambers are displaced away from each other, when the setting tool is again pressed against a constructional component, the sub-chambers are filled with fresh air.

The drawback of the known setting tool is a complicated and expensive to produce, mechanics that provides for expansion of the combustion volume in the combustion chamber.

In a setting tool Hilti GX 100 of the assignee herein, a setting piston is displaced in a piston guide that is adjoined, in the drive-in direction, by a bolt guide. At its end opposite the bolt guide, the piston guide is adjoined by a combustion chamber having a rear wall coaxially displaceable relative to the combustion chamber. When the setting tool is pressed against a constructional component, the rear wall of the combustion chamber is displaced away from the piston cylinder, and the return springs are compressed, whereby the combustion chamber is expanded.

Simultaneously with the expansion of the combustion chamber, it is filled with fresh air. The press-on path is equal to the path of displacement of the combustion chamber rear wall away from the piston cylinder that is equal to the axial length of the combustion chamber. After completion of the setting process and lifting of the setting tool off the constructional component, the combustion chamber rear wall moves back into its initial position under the biasing forces of the return springs, whereby the flue gases are expelled upon collapse of the combustion chamber. The advantage of the above-described setting tool consists in that no accumulator or battery is needed as evacuation of the combustion chamber is effected mechanically.

However, the above-described setting tool has a relatively long press-on path and a relatively large diameter of the combustion chamber.

European Patent EP 0 711 634 B1 discloses a combustion-engined setting tool having a combustion chamber for combusting a fuel gas-air mixture, with ventilator means provided in the combustion chamber for creating turbulence. The ventilator means is driven by an electric motor that is supplied with an electrical energy by a battery.

The use of the ventilator means for rinsing the combustion chamber permits to keep the press-on path rather short.

The drawback of this setting tool consists in its large weight resulted from need in battery or accumulator and in need to replace them when their energy dies out.

Accordingly, an object of the present invention is to provide a setting tool of the type described above in which the drawbacks of the known setting tools are eliminated.

SUMMARY OF THE INVENTION

This and other objects of the present invention, which will become apparent hereinafter, are achieved by forming the transmission device as a cable drive having a transmission member and at least one deflection roller for the transmission member and supported on the press-on element.

With the cable drive according to the invention, the press-on stroke can be transmitted to the combustion chamber for expanding the same in a simple manner, which permits to obtain a short ergonomical press-on stroke with the use of a small number of additional parts, low assembly costs, and a small diameter of the combustion chamber. When, e.g., a single deflection roller is available then the transmission ratio between the press-on stroke and the resulting expansion movement of the combustion chamber sleeve is 1:2. The advantage of the cable drive further consists in that it is less expensive and has a smaller weight in comparison with toothed gear or rack-and-pinion gear.

According to an advantageous further development of the present invention, the transmission member is secured with its first end to the press-on element and with its second end to the combustion chamber sleeve. The transmission device includes at least one second deflection roller for the transmission member supported on a member displaceable relative to both the press-on element and the combustion chamber sleeve. The transmission ratio is, in this case, 1:3 which permits to realize a very short press-on stroke.

Advantageously, the at least one second roller for the transmission member is supported on the guide cylinder which permits to simplify the construction and to provide a preliminary formed assembly of the guide cylinder, combustion chamber sleeve, bolt guide, and cable drive and which can easily be mounted in a setting tool housing.

According to a still further advantageous embodiment of the present invention, the transmission member is secured with the first end to the guide cylinder and with the second end to the combustion chamber sleeve.

With this embodiment of the setting tool, in addition to the deflection roller supported on the press-on element no further deflection roller is needed, which simplifies manufacturing of the setting tool.

Advantageously, spring element(s) is (are) arranged between the guide cylinder and the combustion chamber sleeve and between the guide cylinder and the press-on element. The spring element(s) which is (are) arranged between the guide cylinder and the press-on element has (have) a higher spring force than the spring element(s) arranged between the guide cylinder and the combustion chamber sleeve. It is possible to use a single spring element or a plurality of spring elements in each case. In the initial position of the setting tool, the single spring element or the plurality of the spring elements, which is (are) arranged between the combustion chamber sleeve and the guide cylinder, are resiliently preloaded because of the higher spring force of the single spring element or the plurality of spring elements which are arranged between the press-on element and the guide cylinder, while the single spring element or the plurality of spring elements between the press-on element and the guide cylinder are expanded to a most possible extent. Thereby, when the setting tool is pressed against the constructional component, the single spring element or the plurality of spring elements, which is (are) arranged between the press-on element and the guide cylinder become compressed, while the single spring element or the plurality of spring elements, which is (are) provided between the guide cylinder and the combustion chamber sleeve, expand because of the resilient preloading, whereby the combustion chamber between the piston, which occupies its initial position, and the combustion chamber rear wall expands automatically.

When the setting tool is again lifted off the constructional component, then the spring element or elements, which are arranged between the press-on element and the guide cylinder, expand, displacing the press-on element and the guide cylinder away from each other. As a result, the cable drive would pull the combustion chamber sleeve onto the guide cylinder, whereby the combustion chamber would collapse. The spring element or elements, which are located between the combustion chamber sleeve and the guide cylinder, being compressed, become preloaded again. As the transmission member cable, in particular a steel cable, which has a good durability, can be used, as only tension forces are transmitted by the transmission member.

When the setting tool does not include a plurality of spring elements, a flat steel strip, which can be bent in a plane, can be used as the transmission member of transmitting not only tension forces but also thrust forces.

Advantageously, the press-on element is formed as a bolt guide or its part. This permits to avoid use of additional parts for forming the press-on element, whereby a compact construction can be obtained.

Advantageously, the cable drive has two separate transmission members arranged symmetrically, and at least one first deflection roller for each transmission element and which is provided on the press-on element. With two transmission members, a uniform distribution of forces during the press-on and lift-off step can be achieved, which eliminates the possibility that parts, which move relatively to each other, would tilt toward each other.

Advantageously, there is provided guide means for displaceably guiding the press-on element coaxially toward the guide cylinder. This insures a reliable functioning of the cable drive even after an extended operating life of the setting tool. This is because no torsion takes place between the press-on element and the guide cylinder that might have damaged the transmission member.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
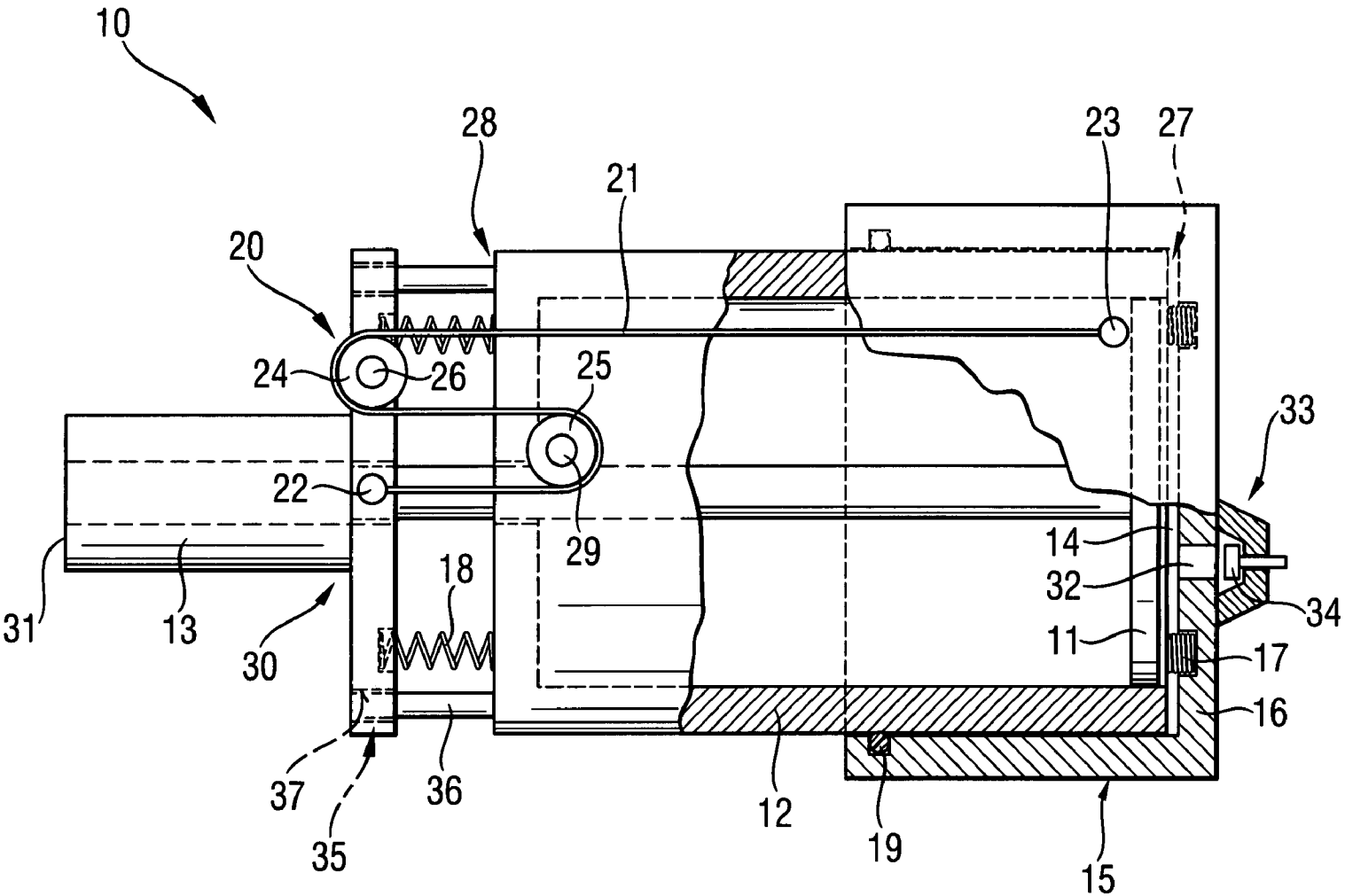
FIG. 1 a longitudinal, partially cross-sectional view of a setting tool according to the present invention in an initial position thereof.
Figure 2:
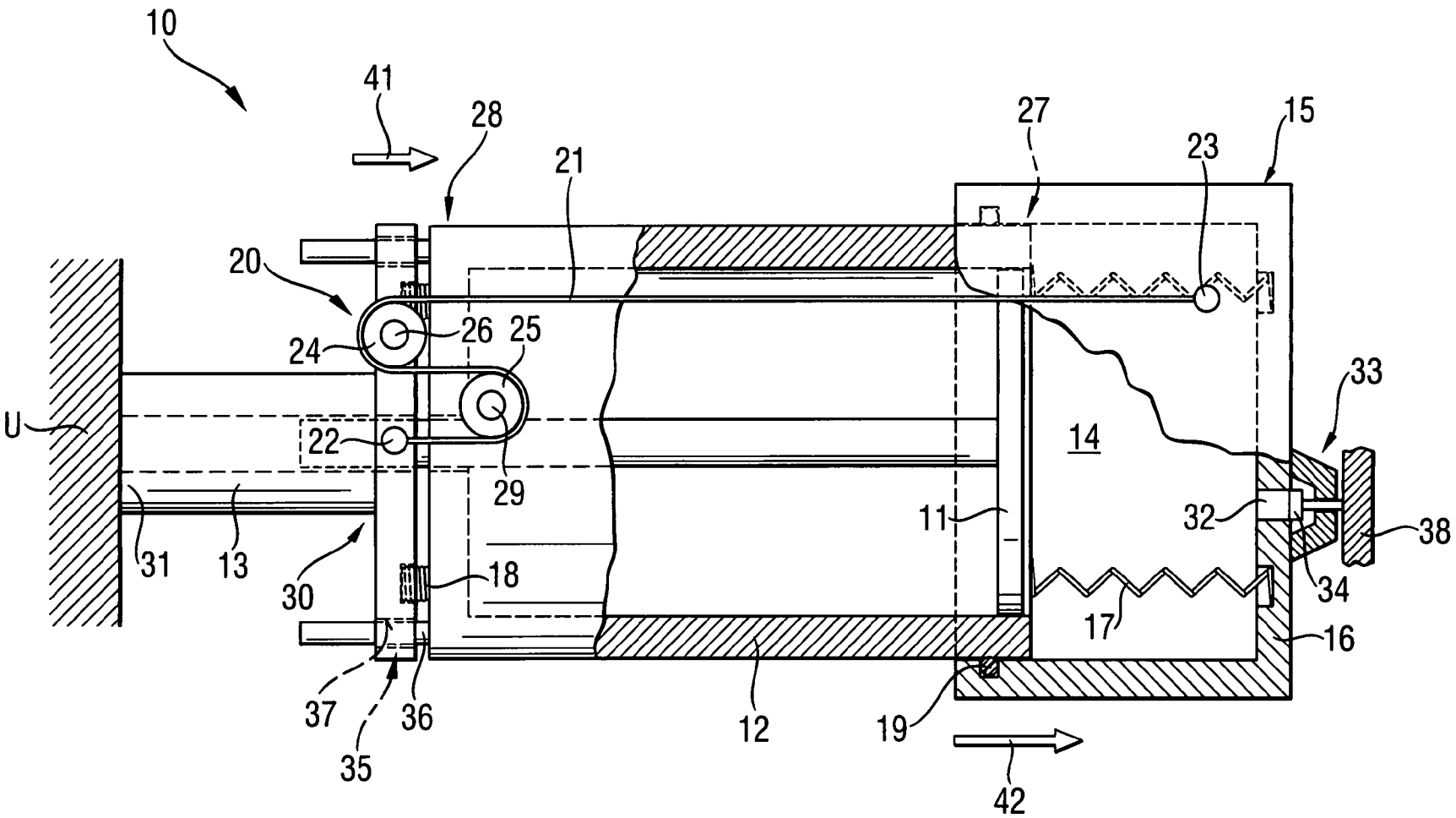
FIG. 2 a longitudinal, partially cross-sectional view of the setting tool shown in FIG. 1 in a position in which the setting tool is pressed against a constructional component.

FIGS. 1-2 show a first embodiment of a setting tool according to the present invention. The setting tool 10 is operated on a fuel gas which is stored in a fuel reservoir (not shown) in form of a liquefied gas. Instead of a fuel gas, an evaporable liquid fuel such as, e.g., alcohol, gasoline can be used. The setting tool 10 has a setting mechanism with which a fastening element, not shown, is driven in a constructional component U when the setting tool 10 is pressed against the construction component and is actuated. The setting mechanism includes, among others, a combustion chamber 14 for an oxidant-fuel gas mixture, a guide cylinder 12 having a first axial end 27 and a second axial end 28, a setting piston 11 axially displaceable in the guide cylinder 12, and a bolt guide 13 adjoining the second axial end 28 of the guide cylinder 12 remote from the combustion chamber 14. The bolt guide 13 serves for guiding a fastening element, e.g., a bolt or a nail, functioning simultaneously as a press-on element 30 that is provided with a press-on nose 31. The press-on element 30 is axially displaceable relative to the guide cylinder 12. Guide means 35 provides for displacement of the press-on element 30 over the guide cylinder 12. The guide means 35 includes guide pins 36 arranged at the second axial end 28 of the guide cylinder 12, projecting therefrom, and guide bores 37 formed in the press-on element 30 in which the guide pins 36 are displaceable.

The combustion chamber 14 is provided in a pot-shaped combustion chamber sleeve 15 that is displaceably arranged on the first axial end 27 of the guide cylinder 12 and is sealed with respect to the guide cylinder 12 by at least one sealing element 19, e.g., a sealing ring. An opening 32 is formed in a rear wall 16 of the combustion chamber sleeve 15. Through the opening 32, an oxidant, such as, e.g., environmental air, and fuel can be fed into the combustion chamber 14. At the opening 32, there is provided a valve 33 with a valve body 34 which closes or opens the opening 32. The valve body 34 is biased in the direction of its open position shown in FIG. 1 by a spring member (not shown). After a setting process, flue gases can be evacuated outwardly through the opening 32.

It should be understood that several openings can be provided. Thus, fuel can be delivered into the combustion chamber 14, e.g., through a separate opening.

On the assembly of arranged one after another press-on element 30, guide cylinder 14, and the combustion chamber sleeve 15, there is provided a cable drive designated generally with a reference numeral 20 and formed as a cable and pulley drive. The cable drive 20 converts the press-on movement of the press-on element 30 in the direction of arrow 41 (FIG. 2) when the press-on nose 31 is pressed against the constructional component U, in movement of the combustion chamber sleeve 15 relative to the guide cylinder 12 in the direction of arrow 42 with a ratio 1:3, i.e., the displacement path of the combustion chamber sleeve 15 relative to the guide cylinder 12 during a press-on process is three times as large as the displacement path of the press-on element 30 relative to the guide cylinder 12, with all of the movements being effected in the longitudinal direction of the guide cylinder 12.

The cable drive 20 includes a transmission member 21 which is formed as a steel cable and is secured with its first end 22 to the press-on element 30 and with its second end 23 to the combustion chamber sleeve 15. The transmission member 21 is guided further over two deflection rollers 24, 25, being deflected twice over these rollers. The first deflection roller 24 and the second deflection roller 25 are rotationally mounted, respectively, on the press-on element 30 and the guide cylinder 12, on respective support pins 26, 29 provided, respectively, on the press-on element 30 and the guide cylinder 12.

Between the press-on element 30 and the second axial end 28 of the guide cylinder 12, there is provided one or several spring members 18 formed as compression spring elements. The spring members 18 press the guide cylinder 12 and the press-on element 30 away from each other in the initial position of the setting tool 10 shown in FIG. 1. The spring members 18 have generally a higher elastic force than spring members 17 provided between the combustion chamber sleeve 15 and the first axial end 27 of the guide cylinder 12. In the initial position of the setting tool 10 shown in FIG. 1, because of the connection of the press-on element 30 and the combustion chamber sleeve 15 by the transmission member 21, which is formed as a steel cable, of the cable drive 20, the spring members 17 are compressed. When the setting tool 10 is pressed against the constructional component U, as shown in FIG. 2, the distance between the guide cylinder 12 and the press-on element 30 is shortened, which results in compression of the spring members 18. As a result of the reduction of the distance between the press-on element 30 and the guide cylinder 12, the spring members 17 are able to displace the combustion chamber sleeve 15 in the direction of arrow 42, whereby the combustion chamber 14 expands. The valve body 34 runs against a stop 38 in the displacement direction of the combustion chamber sleeve 15, so that the valve 33 closes the opening 32 in the completely expanded condition of the combustion chamber 14. In this condition of the combustion chamber 14, it is filled with a fuel-air mixture that can be ignited by an ignition element, e.g., an ignition plug. The setting tool 10 is ready for carrying out a setting process which is actuated by an actuation switch. The stop 38 can be provided, e.g., in an outer housing of the setting tool 10, not shown.

When the setting tool 10 is lifted off the constructional component U in the direction of arrow 41, the spring member 18 expands again, and the cable drive 20 displaces the combustion chamber sleeve 15, while the spring members 17 are being compressed, to its initial position shown in FIG. 1, whereby the combustion chamber 14 collapses. The flue gases, which remain in the combustion chamber 14, are released through the again open opening 32 which becomes open upon movement of the valve body 34 away from the combustion chamber sleeve 15.

Figure 3:
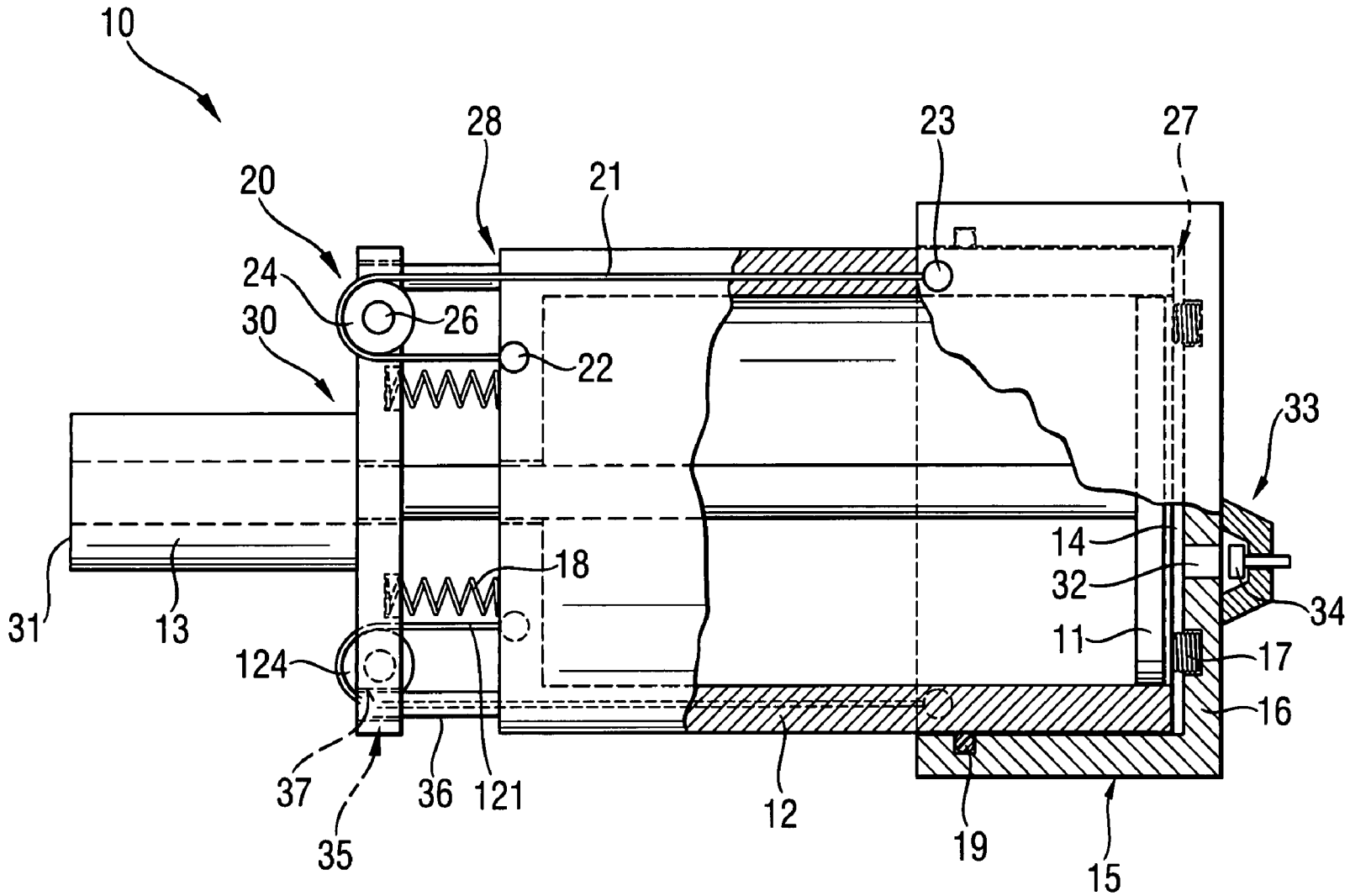
FIG. 3 a longitudinal, partially cross-sectional view of another embodiment of a setting tool according to the present invention in an initial position thereof.
Figure 4:
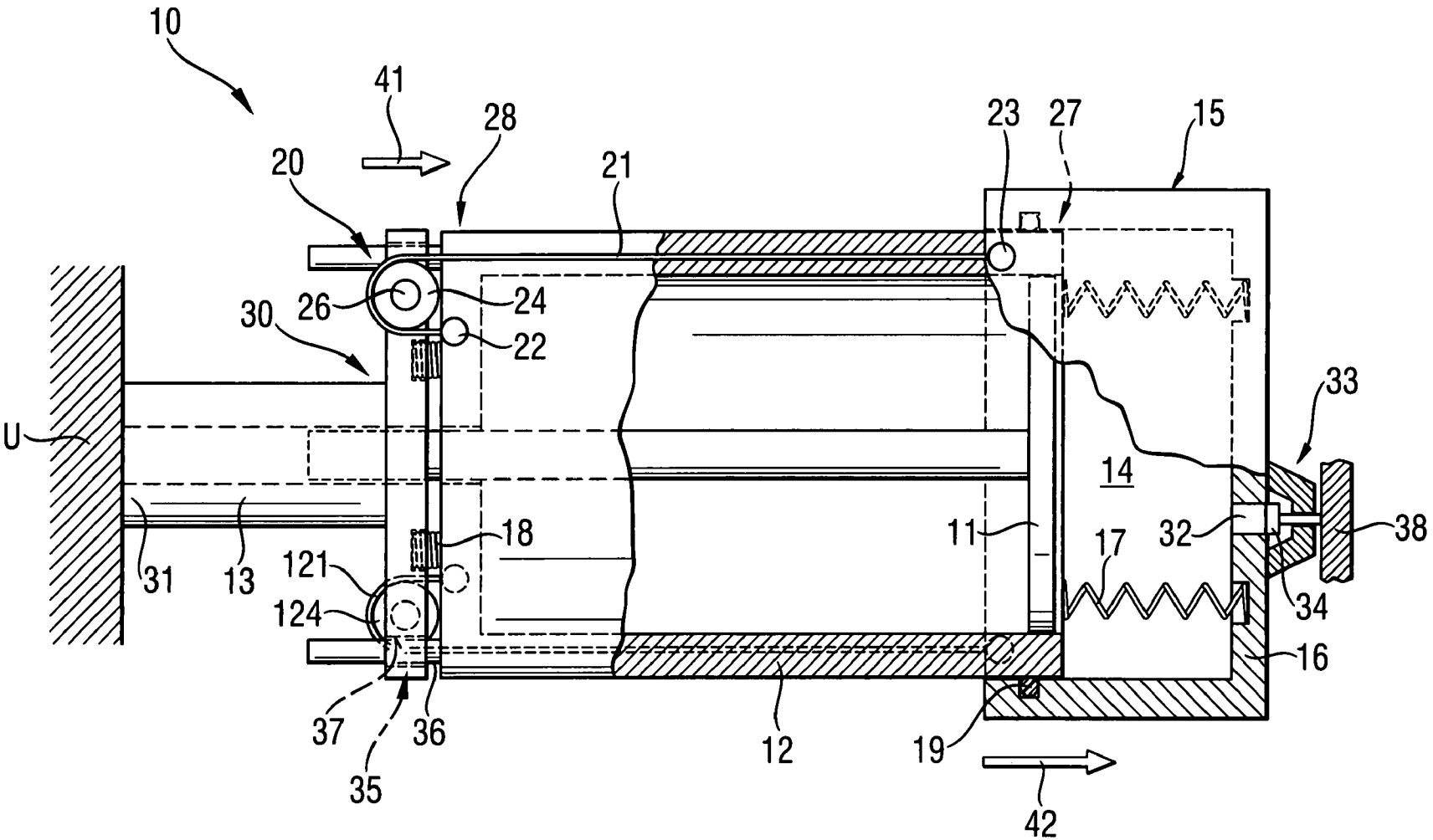
FIG. 4 a longitudinal, partially cross-sectional view of the setting tool shown in FIG. 3 in a position in which the setting tool is pressed against a constructional component.

A setting tool 10, which is shown in FIGS. 3-4, differs from the setting tool 10 described above with reference to FIGS. 1-2, in that the cable drive 20 has two transmission members 21, 121 formed as steel cables. Each of the steel cables 21, 121 is deflected only once about a respective deflection roller 24, 124 which is supported on the press-on element 30. The first end 22 of the transmission members 21, 121 is secured to the guide cylinder 12 and specifically to the second end 28 of the guide cylinder 12 adjacent to the press-on element 30. The second end 23 of the transmission members 21, 121 is secured to the combustion chamber sleeve 15.

When the setting tool 10 is pressed against the constructional component U, as shown in FIG. 4, the distance between the guide cylinder 12 and the press-on element 30 is shortened, which results in compression of the spring members 18. As a result of the reduction of the distance between the press-on element 30 and the guide cylinder 12, the spring members 17 are able to displace the combustion chamber sleeve 15 in the direction of arrow 42, whereby the combustion chamber sleeve 14 expands. The transmission ratio of the movement of the press-on element 30 to the movement of the combustion chamber 15 amounts to 1:2. For other details and functions of the setting tool 10, reference is made to previous description with reference to FIGS. 1-2.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool for driving fastening elements in a constructional component, comprising:

a guide cylinder (12) having opposite first (27) and second (28) axial ends;

a setting piston (11) displaceable in the guide cylinder (12);

a combustion chamber sleeve (15) displaceably arranged at the first axial end (27) of the guide cylinder (12);

a press-on element (30) supported at the second axial end (28) of the guide cylinder (12) in front thereof for displacement relative thereto; and a transmission device mounted to the press-on element (30) and the combustion chamber sleeve (15) such that the combustion chamber sleeve (15) is displaced axially in response to axial displacement of the press-on element (30);

as a cable drive (20) having a transmission member (21, 121) and at least one deflection roller (24, 124) for the transmission member (21, 121) and supported on the press-on element (30).

2. A combustion-engined setting tool according to claim 1, wherein the transmission member (21, 121) is secured with a first end (22) thereof to the press-on element (30) and with a second end (23) thereof to the combustion chamber sleeve (15), and wherein the transmission device includes at least one second deflection roller (25) for the transmission member (21) supported on a member displaceable relative to both the press-on element (30) and the combustion chamber sleeve (15).

3. A combustion-engined setting tool according to claim 2, wherein the at least one second deflection roller (25) is supported on the guide cylinder (12).

4. A combustion-engined setting tool according to claim 1, wherein the transmission member (21, 121) is secured with a first end (22) thereof to the guide cylinder (12) and with a second end (23) thereof to the combustion chamber sleeve (15).

5. A combustion-engined setting tool according to claim 1, further comprising at least two spring elements (17, 18) arranged, respectively, between the guide cylinder (12) and the combustion-chamber sleeve (15) and between the guide cylinder (12) and the press-on element (30), wherein the spring element (18), which is arranged between the guide cylinder (12) and the press-on element (30) has a higher spring force than the spring element (17) arranged between the guide cylinder (12) and the combustion chamber sleeve (15).

6. A combustion-engined setting tool according to claim 1, wherein the transmission member (21, 121) is formed as a cable.

7. A combustion-engined setting tool according to claim 1, wherein the transmission member (21, 121) is formed as a steel cable.

8. A combustion-engined setting tool according to claim 1, wherein the press-on element (30) is formed as a bolt guide (13).

9. A combustion-engined setting tool according to claim 1, wherein the cable drive has two separate transmission members (21, 121) arranged symmetrically, and at least one first deflection roller (24, 124) for each transmission member (21, 121) and which is provided on the press-on element (30).

10. A combustion-engined setting tool according to claim 1, further comprising guide means (35) for guiding the press-on element (30) parallel to the guide cylinder (12).

* * * * *